US005387906A

United States Patent [19]

Lee

[11] Patent Number: 5,387,906

[45] Date of Patent: Feb. 7, 1995

[54] SIGNAL RECEIVING CONTROL SYSTEM OF A REMOTE CONTROL DEVICE

[75] Inventor: Gyung M. Lee, Seoul, Rep. of Korea

[73] Assignee: Samsung Electronics Co., Ltd., Suwon, Rep. of Korea

[21] Appl. No.: 2,583

[22] Filed: Jan. 11, 1993

[30] Foreign Application Priority Data

Jan. 11, 1992 [KR] Rep. of Korea ..... 92 286

[51] Int. Cl.[6] ..... G08C 19/16

[52] U.S. Cl. ..... 340/825.64; 340/825.57; 375/23; 375/99

[58] Field of Search ..... 340/825.57, 825.64; 375/23, 99, 104; 307/234, 271; 328/109

[56] References Cited

U.S. PATENT DOCUMENTS 4,063,180 12/1977 Norman ..... 375/104

FOREIGN PATENT DOCUMENTS 63-10832 1/1988 Japan ..... 340/825.57
1-203000 8/1989 Japan ..... 375/23
2-284533 11/1990 Japan .

*Primary Examiner*—Michael Horabik
*Attorney, Agent, or Firm*—Burns, Doane, Swecker & Mathis

[57] ABSTRACT

A control system includes receiving module for receiving a signal from a transmitting unit. Also included is a microprocessor including an input port for inputting the signal from the receiving module so as to decode the input signal and control the loads of an appliance and an output port for outputting an input control signal with respect to the input port. A signal input control section is connected between the input and output ports for directing the signal from the receiving module either to be applied or cut off to the input port of the microprocessor.

9 Claims, 3 Drawing Sheets

SIGNAL RECEIVING CONTROL SYSTEM OF A REMOTE CONTROL DEVICE

BACKGROUND OF THE INVENTION

1. Field of the Invention

The present invention is related to providing a signal receiving control system of a remote control, and particularly, to providing a control device which receives a signal only for the duration of each of the sampling pulses, and a control method thereof.

2. Description of the Prior Art

A conventional remote control includes a receiving unit which decodes a control signal sent by a transmitting unit as illustrated in FIG. 1. The receiving unit counts the time intervals between two successive falling edges of given pulse signals and discriminates signals "0" and "1" indicative of a data code to determine the presence of a desired or correct signal. The control signal generally contains a reader pulse and a combination of data pulses, each of which has a predetermined time interval corresponding to a binary number, "0" or "1". The time intervals $2t$ and $t$ between successive falling edges are converted into data codes "1" and "0" of a binary signal respectively, so as to control, for example, the operation of an appliance. The data code represented in FIG. 1 expresses "1001" after the reader pulse.

However, a remote control uses a carrier with a frequency band of 30 to 40 KHz, while the power frequency of a common commercial electronic fluorescent lamp device extends from 20 to 40 KHz. This causes problems in decoding the received control signals and leads to the malfunctioning of the appliance. This results because the control signals from the transmitting unit are similar in waveform to the noise signals concurrently being received from the electronic fluorescent lamp device. In other words, the microprocessor of the receiving unit interprets the noise signals as normal control signals. Thus, the desired appliance operation is impaired or prevented. Furthermore, the appliance is not operated due to the environmental condition that the custom code thereof are different from codes set by the input signals.

In order to resolve these problems, Japanese Laid-Open Patent No. 284533/1990 discloses an infrared remote control which comprises means arranged in a transmitting unit for generating the carrier frequencies of N channels and means arranged in a transmitting unit for selecting one of the carrier frequencies of N channels. Also, at least one narrow band pass filter is arranged in the receiving unit for filtering the frequency corresponding to the carrier frequency of N channels. Switching means are arranged in the receiving unit for changing the carrier frequency into a narrow band frequency in which the transmitting unit generates the carrier frequencies of N channels. The receiving unit receives the carrier frequency signal passing through the narrow band pass filter corresponding to the channel switching selection. However, this device increases production costs and increases complexity because additional carrier generating units, carrier selecting elements, narrow band pass filters and switching elements are required in order to guarantee product reliability.

SUMMARY OF THE INVENTION

It is an object of the invention to provide a signal receiving control system of a remote control provided with a simple control circuit for minimizing the risks of malfunction of an appliance due to external noises.

It is another object of the invention to provide a signal receiving control device of a remote control which receives a signal only for the duration of each of the sampling pulses in order to minimize the risks of malfunction of an appliance due to external noises, and a control method thereof.

According to one aspect of the invention, a signal receiving control system of a remote control includes a receiving module for receiving a signal from a transmitting unit and a microprocessor including an input port for inputting the signal from the receiving module to decode the input signal and control each of the loads of an appliance and an output port for outputting an input control signal with respect to the input port. A signal input control section connecting the input and output ports directs the signal from the receiving module either to be applied or cut off to the input port of the microprocessor.

According to another aspect of the invention, a signal receiving control method in a remote control is provided and includes generating sampling pulses having a predetermined duration (Pμsec) for every predetermined cycle (Xmsec) and inputting a signal from a receiving module to a microprocessor only when the sampling pulses are generated. Either a normal control signal or an unwanted noise signal are identified based on the existence of a rising edge or a falling edge in the input signal. The time interval between two successive falling edges is counted and the binary data codes or signals converted corresponding to the counted time value are stored in the microprocessor memory.

BRIEF DESCRIPTION OF THE DRAWINGS

The present invention will now be described in detail with reference to the accompanying drawings: in which.

DESCRIPTION OF THE PREFERRED EMBODIMENT

Figure 1:
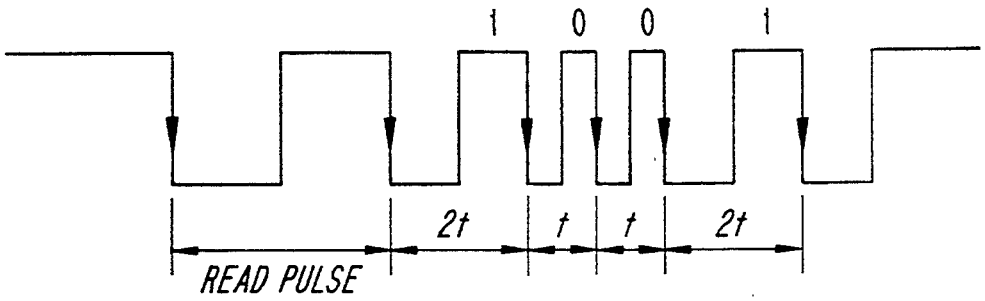
FIG. 1 (PRIOR ART)
FIG. 1 is a view illustrating the waveform of a pulse signal transmitted or received from a conventional remote control.
Figure 2:
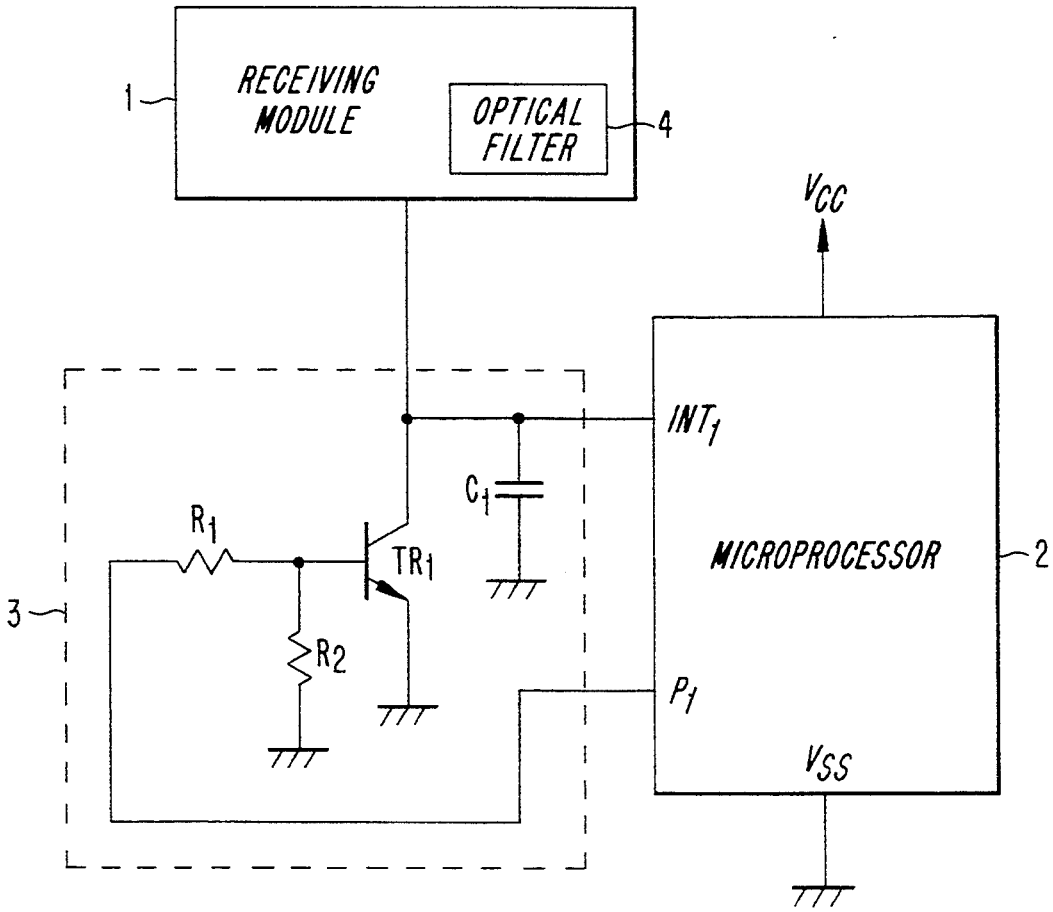
FIG. 2 is a circuit diagram illustrating a signal receiving control device according to the prevent invention.

Referring to FIG. 2, the circuit of a signal receiving control device according to the prevent invention is illustrated. The signal receiving control device comprises a receiving module 1, a microprocessor 2 and a signal input control section 3. The receiving module 1 may comprise an optical filter 4 to prevent the passage of any signal having a longer wave length than a required wave length and also a means for amplifying any acceptable signal. The microprocessor 2 has an input port INT1 to input the signal from the receiving module 1 and an output port P1 for generating sampling pulses of Pμsec for the period of Xmsec. A signal input control section 3 comprises a transistor TR1, a condenser C1 and resistors R1 and R2. The collector of the transistor TR1 is connected with the receiving module 1, the input port INT1 and one terminal of the condenser C1. The base is connected to the output port P1 via the resistor R1. The emitter of the transistor TR1 and the other terminal of the condenser C1 are grounded. Also, the resistor R2 is connected between ground and the base of the transistor TR1.

Figure 4:
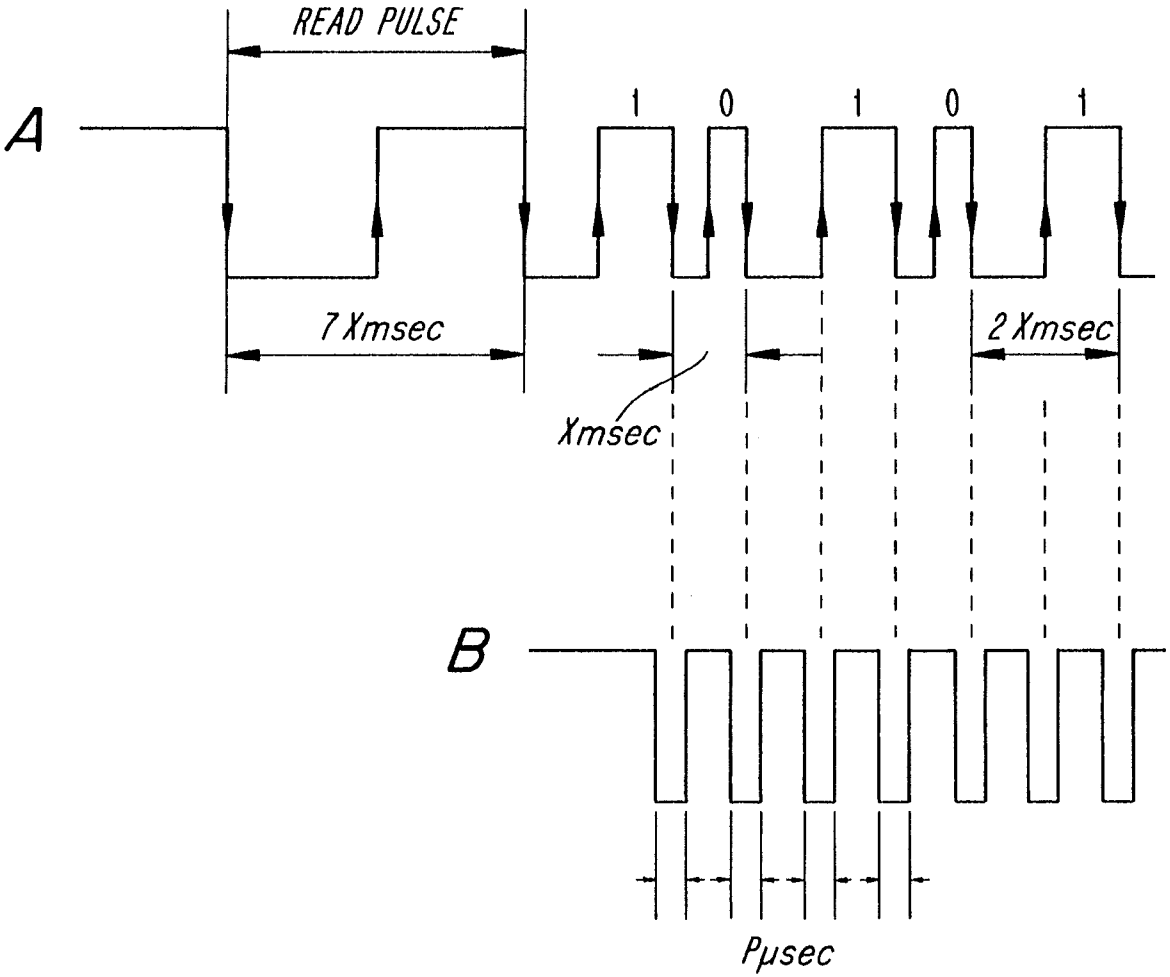

FIG. 4 is a view illustrating a waveform A from a transmitting unit and a wave form B of sampling pulses from a microprocessor according to the present invention. In waveform A, a reader pulse has a time interval of 7Xmsec between falling edges, and data pulses have time intervals between falling edges of 2Xmsec and Xmsec converted into binary data codes "1" and "0" respectively.

Figure 3:
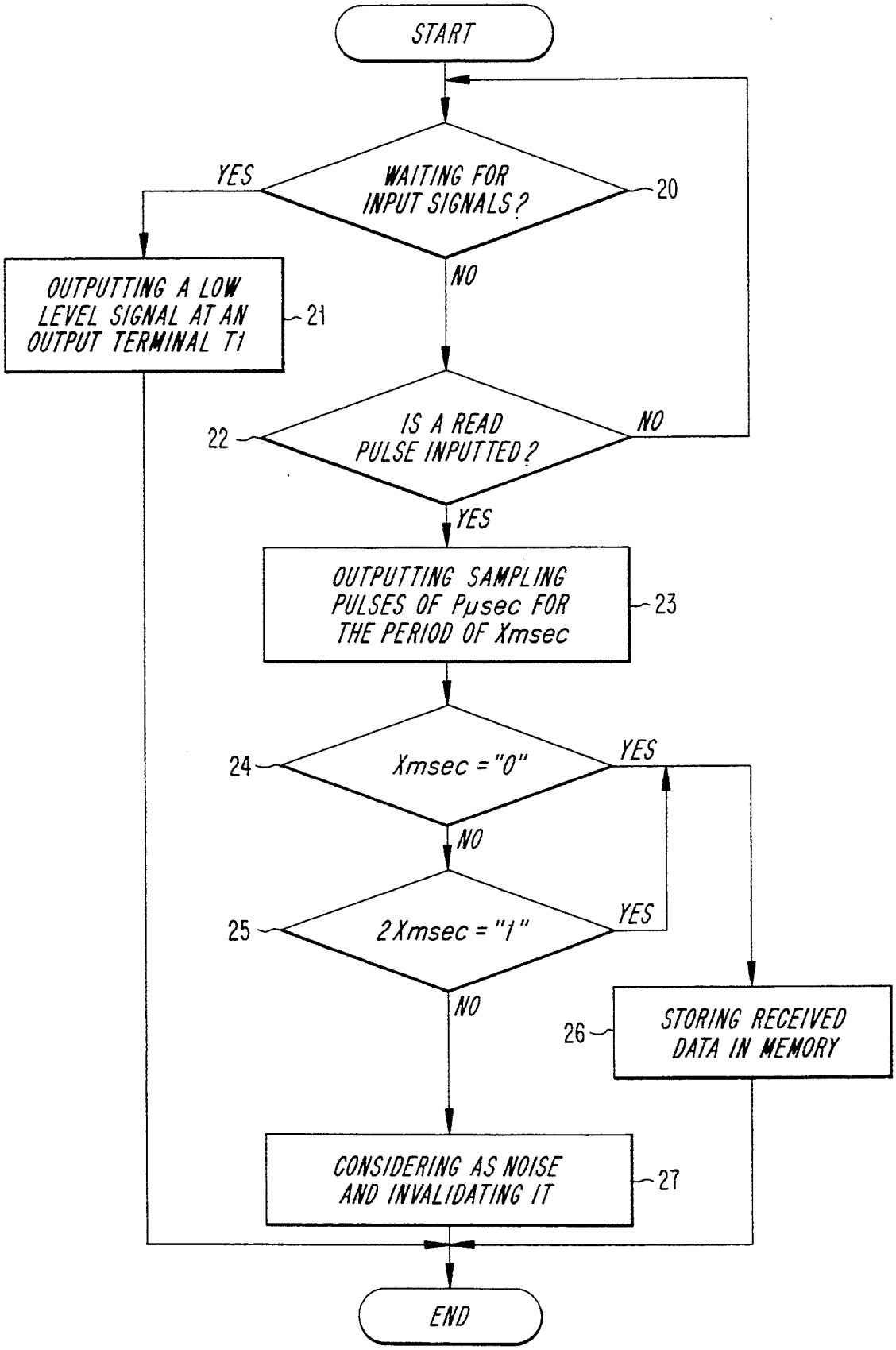
FIG. 3 is a flow chart illustrating a signal receiving control method according to the present invention; and, FIG. 4 is a view illustrating waveform A from a transmitting unit and a waveform B of sampling pulses from a microprocessor, respectively, according to the present invention.

FIG. 3 is a flow chart illustrating a signal receiving control method according to the present invention. Initially, when no signal is passed from the receiving module (step 20), the microprocessor 2 outputs a low level signal to the signal input control section 3 through the output terminal P1 (step 21). Next, the transistor TR1 is turned "off" and the microprocessor 2 is able to input a signal from the receiving module 1 to the input port INT1. In this condition, if the receiving module 1 receives any signal (step 20), the microprocessor 2 counts the time interval between the initial falling edge and the successive falling edge of the input signal. Thus it is determined whether the input portion of the signal is a reader pulse (step 22). If the input portion is a reader pulse, that is, if the counted value is 7Xmsec, the microprocessor 2 generates a sampling pulse signal in which a low level state is maintained for each Pμsec for every predetermined cycle of Xmsec from the output port P1 (step 23). This sampling pulse signal is supplied to the base of the transistor TR1 of the receiving signal input control section 3. When the sampling pulse signal is in a high level state, the transistor TR1 is turned on, thereby bypassing the signal from the receiving module 1 to ground. Thus, no signal is input to the input port INT1 of the microprocessor 2. On the other hand, when the sampling pulse signal is in a low level state, transistor TR1 is turned off. Thus, the signal from the receiving module 1 is input to the input port INT1.

As described above, data pulses following the reader pulse have time intervals between falling edges of 2Xmsec and Xmsec converted, respectively, into binary data codes "1" and "0". Accordingly, if the input signal is normal, the falling edge or rising edge necessarily occurs in the portion of the signal input. When the sampling pulse signal is in a low level state. Thus, if the rising edge or falling edge does not occur in the signal from the receiving module 1 during a low level state, i.e., Xmsec≠"0" and 2Xmsec≠"1" (steps 24 and 25), the input signal is considered to be an unwanted noise signal (step 27). On the other hand, if the rising edge or falling edge occurs in the signal from the receiving module 1 during a low level state, i.e., Xmsec="0" or 2Xmsec="1" (steps 24 and 25), the microprocessor 2 counts the time interval between the two falling edges and stores (step 26) the binary data codes or signals converted corresponding to the counted time value in the memory of the microprocessor 2, not shown. The stored data codes or signals are subsequently used in controlling the operation of the appliance.

It is claimed:

1. A signal receiving control device of a remote control device comprising:

a receiving module for receiving a signal from a transmitting unit;

a microprocessor including an input port for inputting said signal from said receiving module to decode said signal and to control each load of an appliance, and an output port for outputting an input control signal having a first level state and a second level state; and, a signal input control section connected between said input and output ports for inputting said input control signal from said microprocessor, and applying said signal from said receiving module to said input port of said microprocessor when said input control signal is in said first level state.

2. The signal receiving control device according to claim 1, wherein said signal input control section comprises:

voltage dividing resistors;

a transistor, a collector of which is connected to a junction of said receiving module and said input port of said microprocessor, an emitter of said transistor being grounded, and a base of said transistor being connected to said output terminal of said microprocessor via said voltage dividing resistors; and a condenser connected between said junction and ground.

3. A signal receiving control method of a remote control device, comprising the steps of:

generating sampling pulse signals having a low level state and a high level state and inputting a signal from a receiving module to a microprocessor only when said low level state of said sampling pulse signals are generated;

identifying a normal control signal or an unwanted noise signal responsive to a rising edge or a falling edge in said input signal occurring during a low level state and a high level state, respectively, of said sampling pulse signals; and counting a time interval between two successive falling edges and continuously storing in a memory of said microprocessor binary signals corresponding to said counted time interval.

4. The signal receiving control method of claim 3, wherein said binary signals "0" and "1" are respectively stored in said memory of said microprocessor corresponding to said counted time interval.

5. A signal receiving control system comprising:

means for receiving an input signal;

processing means for decoding said input signal and controlling an appliance, said processing means having an input port for receiving said input signal from said receiving means, and an output port through which a sampling pulse signal is generated; and a signal input control circuit, connected between said input port and said output port of said processing means, for controlling whether said input signal is received by said processing means based on a state of said sampling pulse signal.

6. The system of claim 5 wherein said signal input control circuit includes:

a voltage dividing resistor;

a transistor, a collector of said transistor being connected to a junction between said receiving means and said input port of said processing means, and a base of said transistor being connected to said output port by way of said voltage dividing resistor; and a condenser connected between said junction and ground.

7. The system of claim 5 wherein said receiving means includes an optical filter.

8. A signal receiving control method of a remote control device comprising the steps of:

generating sampling pulses each having a predetermined duration;

receiving an input signal for processing when said sampling pulses are generated;

identifying a control signal according to whether an edge of said input signal occurs during said predetermined duration of said sampling pulses;

determining a time interval between said edge and a next occurrence of said edge in said input signal; and storing signals corresponding to said time interval for controlling an appliance.

9. The method of claim 8 wherein said stored signals are binary codes.

* * * * *